US008206052B1

(12) United States Patent
Hayman

(10) Patent No.: US 8,206,052 B1
(45) Date of Patent: Jun. 26, 2012

(54) MODULAR SCAFFOLD HORIZONTAL END CONNECTOR

(75) Inventor: Yates W. Hayman, Walker, LA (US)

(73) Assignee: Excel Modular Scaffold and Leasing Corporation, Walker, LA (US)

( * ) Notice: Subject to any disclaimer, the term of this patent is extended or adjusted under 35 U.S.C. 154(b) by 227 days.

(21) Appl. No.: 12/489,166

(22) Filed: Jun. 22, 2009

(51) Int. Cl.
*E04G 1/20* (2006.01)

(52) U.S. Cl. ..... 403/49; 182/186.8; 403/321; 403/325; 403/330

(58) Field of Classification Search ..... 403/49, 403/171, 176, 321, 322.1, 325, 326, 327, 403/330; 52/651.1, 655.1; 182/179.1, 186.7, 182/186.8
See application file for complete search history.

(56) References Cited

U.S. PATENT DOCUMENTS

| | | | | |
|---|---|---|---|---|
| 4,445,307 | A * | 5/1984 | Puccinelli et al. | 403/49 |
| 4,577,367 | A * | 3/1986 | Durand | 220/759 |
| 5,028,164 | A * | 7/1991 | Williams | 403/49 |
| 5,078,532 | A | 1/1992 | Williams | |
| 5,217,314 | A * | 6/1993 | Perruelle | 403/49 |
| 5,713,687 | A * | 2/1998 | Schworer | 403/49 |
| 6,375,405 | B1 * | 4/2002 | Kallevig | 414/723 |
| 7,017,710 | B2 * | 3/2006 | Booysen et al. | 182/178.1 |
| 7,048,093 | B2 * | 5/2006 | Wallther | 403/49 |
| 7,971,686 | B1 | 7/2011 | Hayman | |
| 2009/0052980 | A1 * | 2/2009 | Williams | 403/49 |

* cited by examiner

*Primary Examiner* — Michael P Ferguson
(74) *Attorney, Agent, or Firm* — Jones, Walker, Waechter, Poitevent, Carrere & Denegre, LLP

(57) ABSTRACT

The invention is an end connector for a horizontal scaffold member where the top of the end connector is inserted into the interior of a scaffold pipe. The invention includes a locking latch that includes a rotating latch member and a rotating lock that interfere when the latch is locked.

7 Claims, 15 Drawing Sheets

MODULAR SCAFFOLD HORIZONTAL END CONNECTOR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The invention is in the field of scaffolding.

2. Description of Related Art

Modular scaffolding is a system scaffold having horizontal scaffold members and vertical scaffold members designed to be clipped or coupled together at a scaffold joint to create a scaffold structure. Once a scaffold structure is assembled, scaffold planks or boards are placed across horizontal scaffold members to create a scaffold deck or working surface. Scaffold planks are usually designed to couple to horizontal scaffold members—generally, the end of each plank has two hook sections, one at each side of the plank, sized to couple with the horizontal scaffold pipe.

A scaffold joint comprises a connector on the vertical scaffold member that is designed to couple or mate with a connector on a horizontal scaffold member, thereby joining together a horizontal and vertical scaffold member. One type of modular scaffold joint uses an end connector positioned on the end of a horizontal member, where the end connector has lip or hook sections. The lip sections are designed to engage or rest on cups or annuli rings positioned on a vertical scaffold member. One such joint is disclosed in U.S. Pat. No. 4,445,307, which discloses a connector positioned on a horizontal scaffold member, where the connector has two vertically spaced hook sections. These hook sections couple with two vertically spaced upstanding ring members located on the vertical scaffold member. To lock the joint in place, the connector includes a wedge that is driven (generally by a hammer) into position below the upper ring member, thereby wedging the ring against the end connector hood section, latching the horizontal member to the vertical member. As used herein, "latching" refers to the action of engaging a horizontal member to a vertical member, where the action of latching resists dislodgement of the horizontal member from the vertical member from an upwardly directed force.

A second type of latching connector is disclosed in U.S. Pat. Nos. 5,078,532 and 5,028,164, hereby incorporated by reference. These patents also show an end connector positioned on a horizontal scaffold member, where the connector has two vertically spaced hooked sections that couple with two vertically spaced upstanding ring members located on the vertical scaffold member. In this device, the latching of the ring members to the hooked sections is accomplished by a deploying a pivoting member or latch, positioned on the end connector, into position below the top ring member. The latch member has a distal end extending beyond the housing, shaped to allow for placement of the distal end beneath a cup or annular ring positioned on a vertical scaffold member. Hence, when latched, the cup or annular ring is trapped between the hook engagement sections of the connector housing and the distal end of the latch member. The latch pivots on a pivot pin, and can be spring loaded to bias the latch into a locking or actuated position.

The proximal end of the latch extends beyond the housing to create a handle, allowing an operator to grasp the handle to actuate or release the latch member. This action allows for hand actuation of the latch for engagement and disengagement, an improvement over the hammer driven wedge of the U.S. Pat. No. 4,445,307. The pivoting latch member allows for ease of assembly of a scaffold structure, and the assembled joint retains a degree of play, as this connector lacks the wedging action of the '307 patented device.

A third type of latching mechanism is that disclosed in U.S. application Ser. No. 11/738,273, filed Apr. 20, 2007 (hereby incorporated by reference). This application teaches a horizontal scaffold member having an end connector with two hook or engagement areas, each designed to couple with a ring or annulus located on a vertical member. The connector includes an upper and a lower latch, each the respective upper and lower coupled ring or cup members, The two latches are mechanically coupled allowing for single action operation to engage or disengage both latches simultaneously.

On each of these modular systems, the horizontal and vertical scaffold members are constructed of hollow steel pipe, preferably galvanized pipe. A commonly used pipe is 1¾ inch diameter steel pipe, having ⅛ inch wall thickness. The end connector is fixed to the end of the horizontal pipe scaffold member, usually by welding the connector to the outside of the pipe. Hence, the end of the horizontal scaffold member, at the connector join, is thicker than the horizontal pipe member (by at least ¼ inch, if ⅛ inch steel is used to construct the connector) due to the presence of the end connector. This increase in thickness is problematic when attaching a scaffold deck.

Scaffold planks or boards are coupled across horizontal members to create a decking or working surface. Scaffold planks used in a modular system are generally a steel plate having two downward directed side channels that provide rigidity to the plank. See FIGS. 8A and 8B. Each end of the plank has a cutout or hook section 500 on each side channel, designed to engage a horizontal scaffold pipe member (e.g. a semicircular cutout to engage a round pipe member). For ease of manufacturing and assembly of a scaffold plank, the plank end side channel cutouts are usually separate metal pieces that are later welded or otherwise joined to the plank's side channels.

The existing scaffold end connector comprises a housing, where the latching, latch pivot pins, springs and spring pivot pins, etc are generally maintained in the interior of the housing. The housing is manufactured from plate steel using a die to cut and shape the connector form, and several connectors will be cut at the same by the die. See FIG. 6, detailing the shape of the initial die housing layout. Initial action of the die operation cuts the two sides of an end connector housing 600 and 610, which are joined by rear sections 800A and 800B, and also punches holes in the housing sides to accommodate the latch and spring pivot pins. Adjoining end connectors are joined by metal fingers 750 that will be later removed and discarded. After the initial cut, the die operation will also initially shape each end connector into a desired form—the lateral tabs are bent at ninety degrees, the tops sides of the housing 700 will be shaped to resemble a portion of a cylindrical body (for engagement with the exterior of the horizontal pipe member), and the bottom of the two sides are also flared outwardly (to create a larger mouthed hook section for additional surface area support by a cup on a vertical scaffold member). See FIGS. 7A-7C. In the final die operation, the projecting fingers 750 are removed and the two sides of the housing 600, 610 are folded into an opposing relationship (e.g. the two sides are parallel), by folding or bending rear sections 800A and 800B into a "U" configuration (see FIG. 7A). The die operation may take several discrete steps (e.g. punch out general shape, form the cylindrical top ends, and bend the two sides into an opposing relationship).

After the die operation, two formed end connectors are placed in a jig, a horizontal pipe positioned between the two connectors, and a reinforcing brace positioned on each end connector. The assembled horizontal scaffold member is then welded to form a unitary horizontal scaffold member—the bent lateral tabs on each end connector are welded to the opposing housing side (fixedly joining the two sides of the housing together), the horizontal pipe is welded to the cylindrical sections 700 of the connector sides, and the brace is welded to the end connector and the pipe. Given the construction of the joint, welds are required on the front and rear face of the end connector (to join the lateral tabs), and the top and bottom of the pipe (to join the connector to the pipe), as well as two welds required for the brace. The finished welded end connector has an internal space between the two sides of the housing to accommodate placement of the chosen latch device. The springs, pivot pins and latch members are next installed in the end connector interior to create a finished horizontal scaffold member.

The current end connector design is opened on the top of the connector (see FIG. 7A), thereby exposing the pivot pins and latch members to possible damage from debris falling into the open top (such as mortar, screws, etc) Also, the end connector is formed by bending and stretching portions of the punched connector form—e.g the two sides of the connector are formed from a single piece of metal and bent into an opposing relationships, while the top of the connector is physically stretched and deformed to form the cylindrical top portions 700. This bending and deformation can cause misalignment of the two opposing sides, creating a twisted end connector with pivot pin holes that do not align properly and with top and bottom hook sections that may be misaligned for proper engagement with the vertical scaffold member. The inventors have found that about 10% of end connectors have twisted sides or other alignment issues that either make the end connector unusable, or requires hand correction, a time consuming operation. A twisted end connector may create safety issues, and such may not be apparent until after the horizontal scaffold member joint is completed and it is discovered that the twisted horizontal scaffold member will not properly engage the cups on vertical scaffold members on one or both ends of the horizontal scaffold member.

Finally, the end connector adjacent to the horizontal pipe 200 is wider than the horizontal pipe (See FIG. 7B). Consequently, scaffold boards cannot be place over the end connector joint, as the hook sections of the scaffold boards 500 are sized for the pipe 200, not the wider joint of top section 700 to pipe 200. Hence, a gap of about three inches is created in the working surface near a vertical scaffold member—that is, the edge of the working surface stops about three inches from a vertical "wall" of a scaffold structure (see FIG. 7B). A new housing is needed that avoids these problems.

Finally, the present hand actuated latching mechanisms, either the single latch or double latch mechanisms, do not provide a secure positive lock. That is, while these latches resist dislodgment by an upward force, a sufficient twisting force may still dislodge a horizontal member from a vertical member. A positive locking latch is also needed.

BRIEF SUMMARY OF THE INVENTION

The invention is a end connector for a horizontal scaffold member where the top of the end connector is inserted into the interior of a scaffold pipe. The invention includes a locking latch that includes a rotating latch member and a rotating lock that interfere when the latch is locked.

DETAILED DESCRIPTION OF THE INVENTION

End Connector Housing

Figure 1:
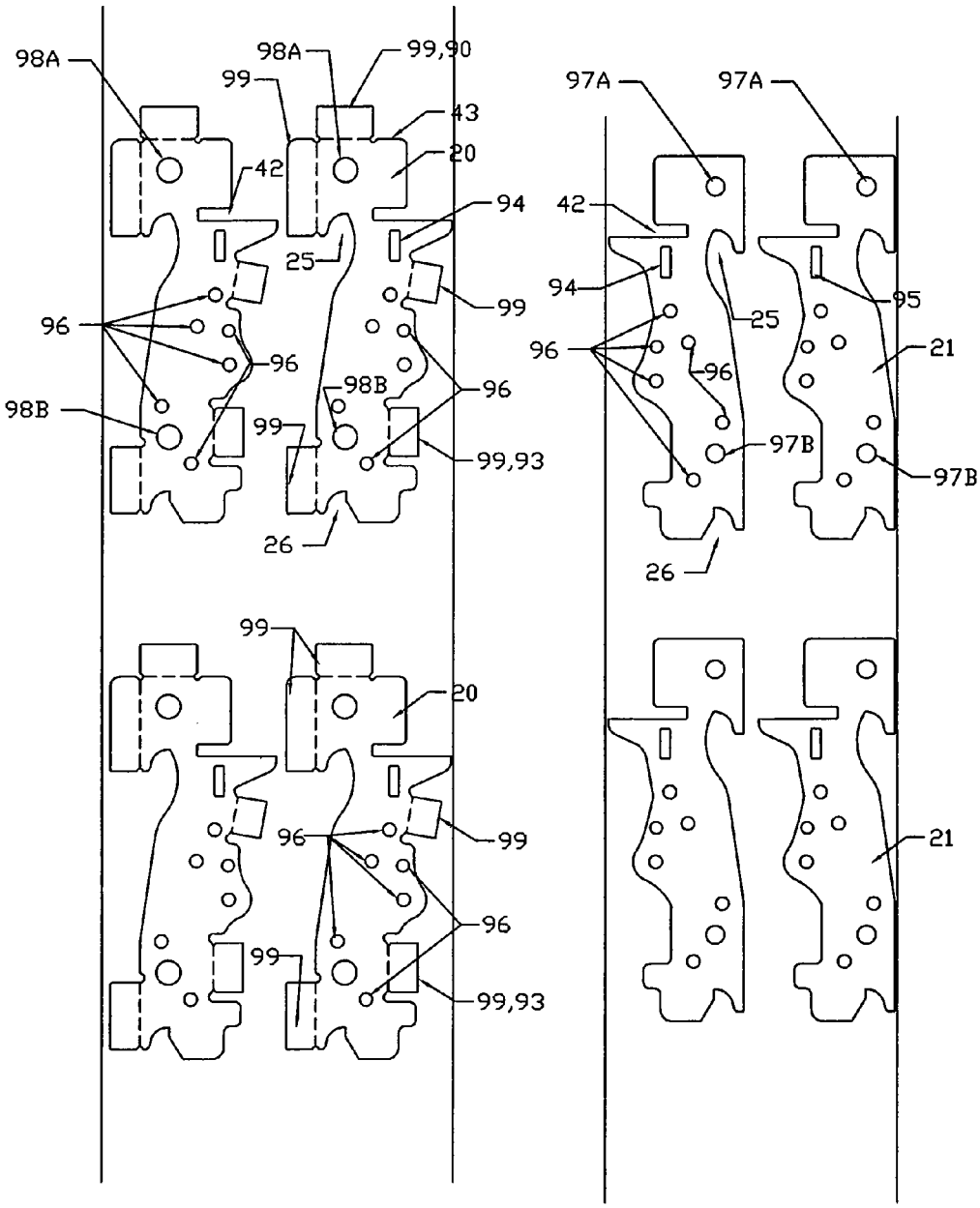
FIG. 1 depicts plate steel with the two sides of one embodiment of the housing outlined on the steel, to be cut by a die operation.
Figure 2:
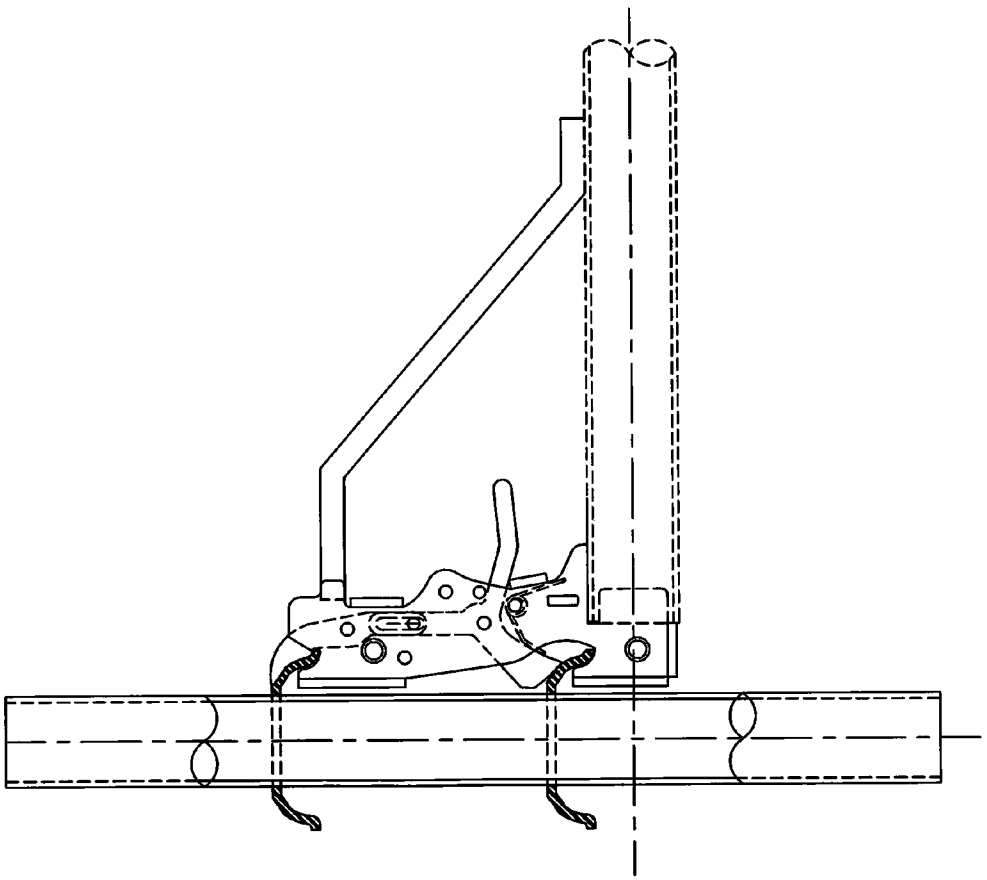
FIG. 2 is a cross section through one embodiment of a connector housing installed in a scaffold joint, where a dual latch member is deployed within the connector housing.
Figure 11:
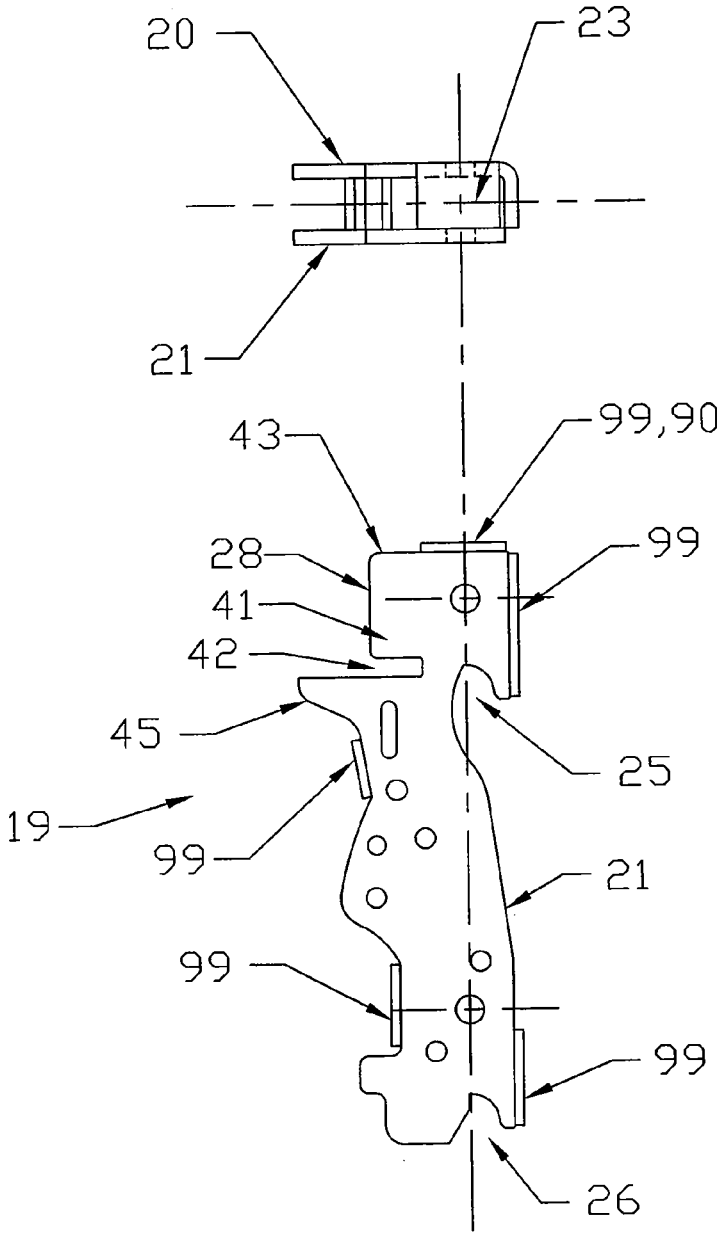
FIG. 11 is a side view of the horizontal connector formed by the cutouts of FIG. 1.
Figure 12A:
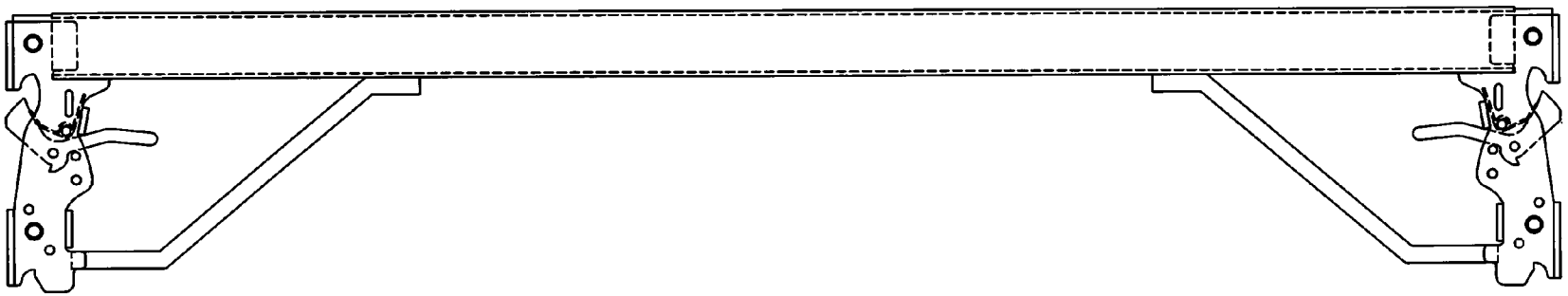
FIGS. 12A-D are cross sections through horizontal scaffold members showing different latching configurations.
Figure 12B:
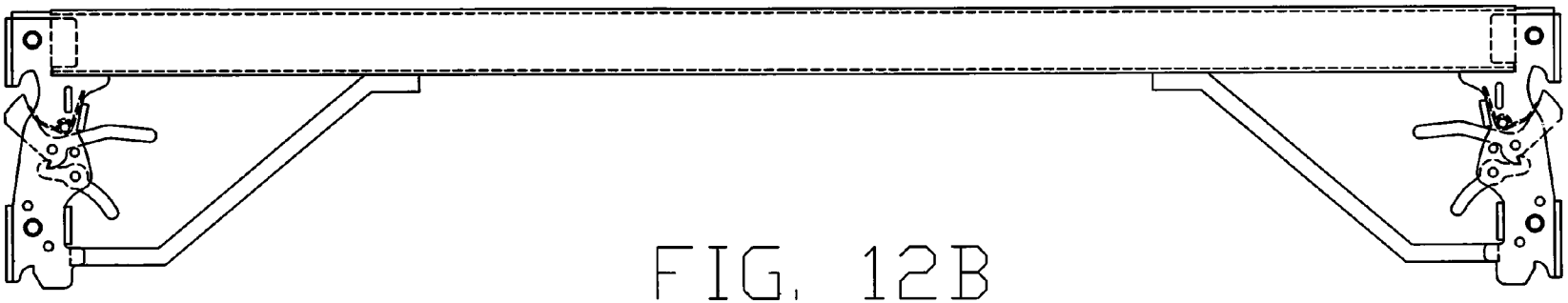
Figure 12C:
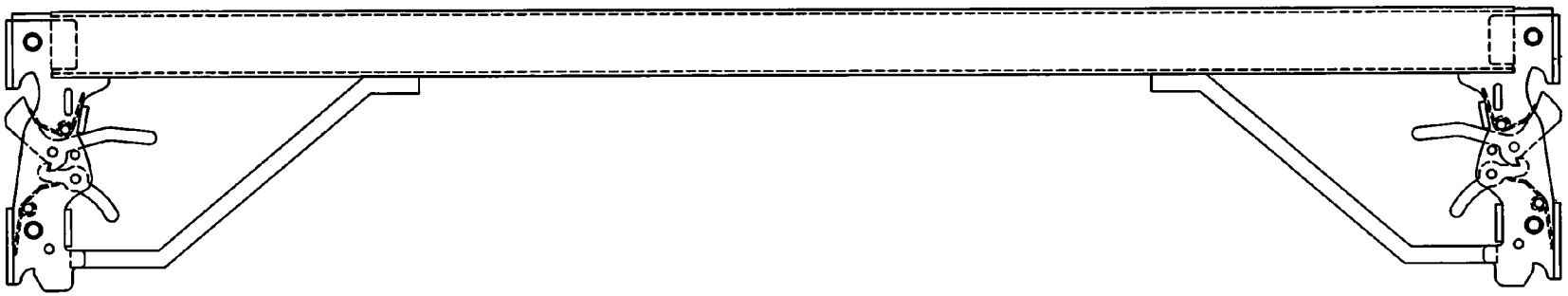
Figure 12D:
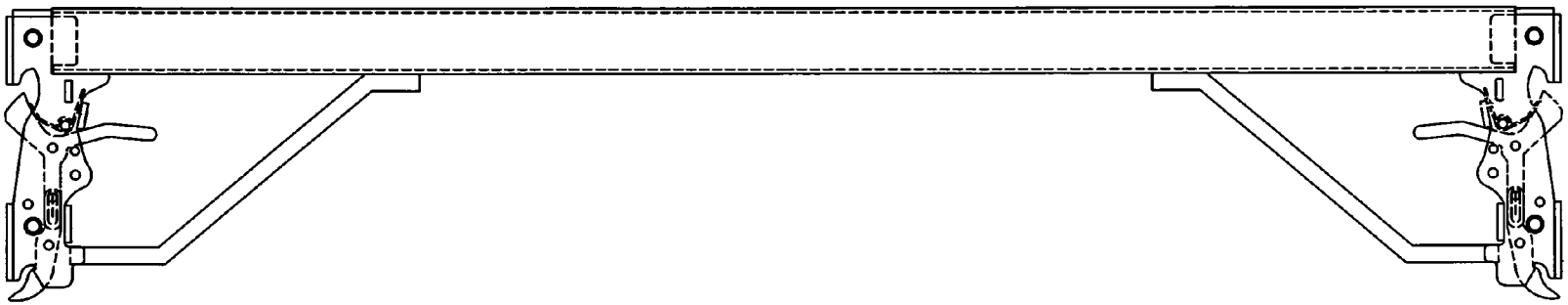

Shown in FIG. 11 is a preferred embodiment of a new end connector housing 19. For orientation, "front" or "frontwardly" (as opposed to "rear") references the end of the connector that attaches to a vertical scaffold member. "Up" or "upwardly" (as opposed to "down") references the "top" of the connector (when attached to a vertical scaffold member) (so upward motion is motion from the bottom of the connector toward the top of the connector). The housing has two opposing sides, forming an interior 23 there between. Each side is formed separately from a sidewall 20 and 21, best seen in figure. Sidewalls 20 and 21 are substantially minor images of one another, with the exception of lateral tabs 99 and openings 97A, 97B, 98A and 98B (see FIG. 1). The end connector has a front and rear portion (from facing the vertical scaffold member). Lateral tabs may be formed in only one sidewall (preferred), as depicted in FIG. 1, or on both sidewalls (not shown). Each sidewall has an upper 25 an lower 26 engagement hook section for engaging a cup 300 or annular ring on a vertical scaffold member 100. The upper rear portion 28 of each side of the housing forms an insertion tab 41 that is sized to be inserted into the interior of a horizontal scaffold pipe 200 (see FIG. 2). In the embodiment shown, other than the lateral tabs 99, each side is substantially flat, including the insertion tab 41. The bottom of each insertion tab 41 is defined by a slot 42 in the housing sidewall, where the slot 42 is dimensioned to accommodate the wall thickness of the horizontal pipe scaffold member (accounting for the curvature of the pipe between the opposing insertion tabs). A rearward extending supporting finger 45 area is formed beneath the slot 42 on each housing sidewall to create additional surface area for welding each sidewall of an end connector to a horizontal pipe. See FIG. 2. As described, the sidewall usually will be fixedly joined to the pipe only along the rearward supporting finger 45. As the insertion tabs 41 are to be inserted into the interior of the horizontal pipe 200, the insertion tabs 41 do not need to be shaped into a portion of a cylindrical surface—indeed, it is preferred that these tab be flat, flush with the respective sides of the connector 19.

Additionally, a lateral tab 99 can be formed at the top 44 of a sidewall, forming a top cover 90 when the tab 99 is bent or folded ninety degrees to the plane of the connector sidewall. The top cover 90 will close the opening on the top of the connector when the two sidewalls 20 21 are joined together, thereby protecting the latching components interior to the connector. The top edge 43 of each insertion tab 41 is preferably lower than the top cover 90 of the connector. Preferably, the difference in height is sufficient to accommodate the thickness of a horizontal scaffold pipe so that when an end connector is attached to a horizontal scaffold pipe 200 (the insertion tab 41 is inserted into the interior of a pipe 200), the top cover 90 is substantially flush with the top exterior of the horizontal scaffold pipe (see FIG. 2).

The connector 19 housing is preferably formed from plate steel using a die operation. Each sidewall of the connector 21, 20 is separately cut or stamped by a die operation, with desired lateral tabs 99 and openings 96 formed to accommodate the pivot pins. An example of layouts for end connector sidewall 21 and 20 formation is shown in FIG. 1. Other layouts can be designed to minimize the waste metal from the die operation. The location of the desired lateral tabs 99 for the end connector will depend on the latching mechanism selected. For instance, latch handle portions that extend out of the housing must not be blocked by lateral tabs. Additionally, the lateral tabs also are used as a spring biasing surface when spring loaded latches are utilized (see, e.g., FIG. 5), and hence, must be located for engagement with the desired biasing springs. Finally, the openings 96 cut to accommodate pivot or support pins (for spring operation) will be dependent on the type of latch mechanism deployed in the connector. The sidewall layout for sidewalls 20 and 21 shown in FIG. 1 is suitable for the three latching mechanism disclosed herein (See FIGS. 12A-12D).

In the preferred embodiment, the two sidewalls 20 and 21 of the connector housing are separately formed and each substantially flat (excluding the lateral tabs 99), thus avoiding the metal deformation, potential twisting and associated alignment problems inherent in the prior art connectors. By forming each sidewall 20 and 21 separately, the layout can also be optimized for conserving metal, resulting in less scrap metal then created by the prior art end connectors. Finally, a horizontal scaffold pipe 200 joins to the new connector 19 closer to the hook sections 25 and 26 (about an 1.25 inches closer), and as the insertion tabs are internal to the pipe. Hence, there is no increase in the external diameter of the joint at the pipe end, so the new connector 19 allows a scaffold board to be positioned much closer to the edge of the new connector 19, and closer to a vertical scaffold member (almost 3 inches closer than the prior design), providing for a safer work surface.

Assembly of a Horizontal Scaffold Member

Because the two sidewalls are separately formed, a jig 1 is used to couple the two sidewalls 20 and 21 into a completed end connector and to form a horizontal scaffold member. Top openings 98A and 97A, and bottom openings 98B and 97B on sidewalls 20 and 21 are designed for used with the jig. The top openings 98A and 97A are designed to be aligned in a completed end connector (that is the center of each opening is aligned on a line that is perpendicular to the plane of the openings), as are the bottom openings 98B and 97B. However, the openings 97A and 97B on sidewall 21 are smaller than the openings 98A and 98B on sidewall 20 (in the current embodiment, openings 97 are about 0.375 in diameter, while openings 98 are about 0.500 inches in diameter). This difference is size is used to assist in assembling the two sidewalls 20 and 21 into a completed end connector, as follows.

Figure 9:
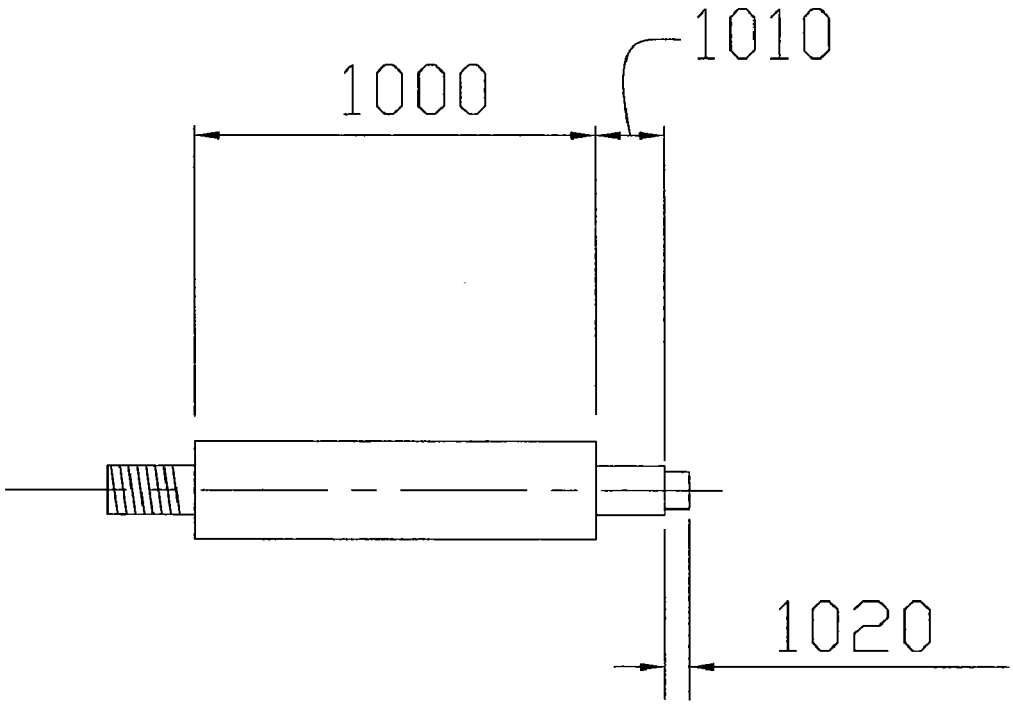
FIG. 9 is a side view of a fixture used to assemble the end connector of FIG. 2.
Figure 10:
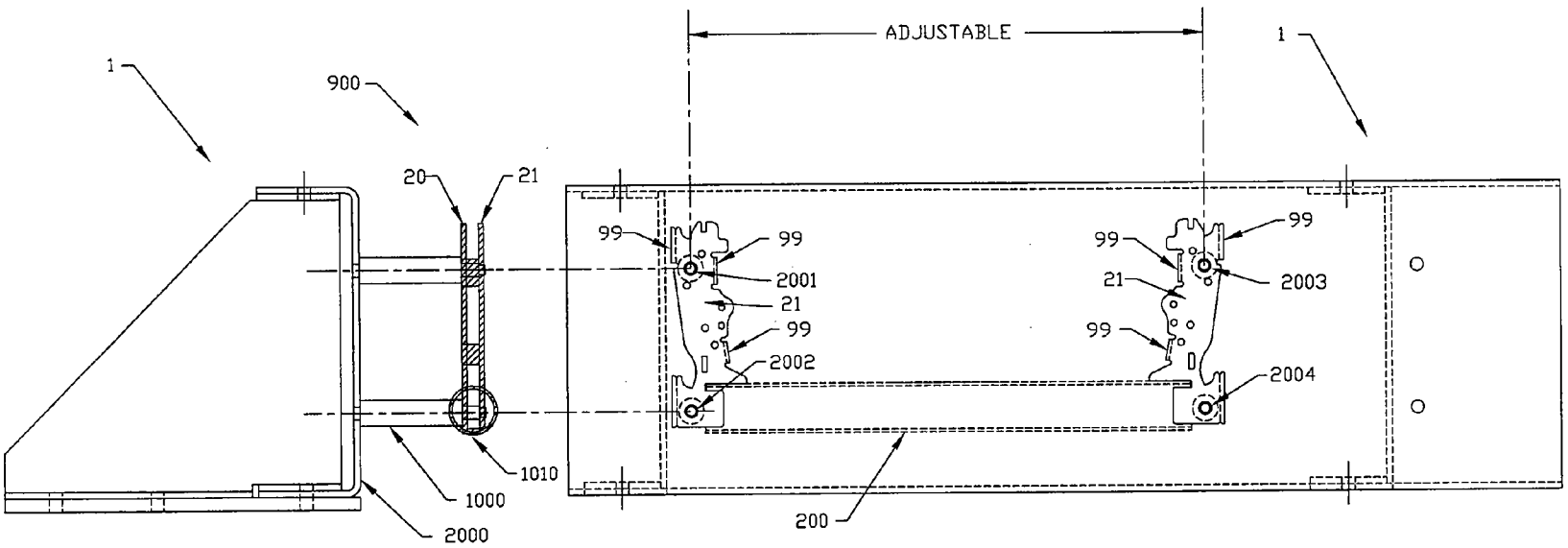
FIG. 10 is side and top view of an assembly jig for a horizontal scaffold member employing the fixture of FIG. 9.

The assembly jig 1 includes four identical standoff members 900 at locations 2001, 2002, 2003 and 2004, as shown in FIG. 10. The standoff member 900 is a "stacked" cylinder that is attached to the jig structure (see FIG. 9). The standoff 900 has three cylindrical volumes, a first cylinder 1000 having a diameter larger that that of the openings 98A and 98B, a second cylindrical volume 1010 having a diameter slightly smaller that that of openings 98A and 98B, and a third cylindrical volume 1020 having a diameter slightly smaller that that of opening 97A and 97B.

To assemble a horizontal scaffold member, a sidewall 20 are slipped over the standoffs 900 located at opposite ends of the jig (e.g. one sidewall over positions 2001 and 2002; another sidewall at positions 2003, 2004). Sidewall 20 will butt up against the end of cylindrical volume 1000 of standoffs 900. Next, two sidewall 21s are slipped over the standoffs 900 at opposite ends of the jig. Sidewall 21 will butt up against the end of cylindrical volume 1010. The length of cylindrical volume 1010 (the distance between cylinders 1000 and 1020) is set to the desired spacing between the sidewalls 20 and 21 of the connector (creating the interior space) plus the thickness of sidewall 20. Hence, the four standoffs 900 are located on the jig to position the adjacent sidewalls 20 and 21 of an end connector in the proper spatial relationship, as well as to position the two opposing end connectors to accept a pipe 200 in the proper spatial relationship—i.e. the sidewalls 21 and 20 of each end connector 19 are properly aligned and separated by the proper distance, and the two opposing end connectors 19 are aligned in a single plane to accept a pipe 200 therebetween.

The sidewalls 20 and 21 are held in place on the standoffs by a clamp, snap cap, or other means. The desired length of pipe is added between the two assembled end connectors (preferably, the jig is designed so that the space between the two end connectors is adjustable, to allow the construction of various length horizontal scaffold members), by inserting insertion tabs 41 into the interior of the pipe 200. The braces are placed in position on the end connector/pipe combination (not shown), and the assembly is ready for welding. As can be seen, the free end of the bent or folded lateral tabs 99 are now positioned adjacent to sidewall 21, away from the jig 1, for ease of welding. Hence, all areas to be welded are easily accessible for automatic welding. Indeed, the length of the cylindrical volume 1000 is designed to sufficiently offset sidewall 20 from the face 2000 of the jig to allow welding of sidewall 20 to the pipe 200 without the need to reposition the assembly. Automatic welding by a robot can readily be accomplished. After welding, galvanization (if desired) will be undertaken, and finally, the desired latching device will be positioned in the interior of the welded end connectors.

As can be seen, the assembly jig ensures that the connector sidewalls 20 and 21 are properly positioned with respect to each other, that the two end connectors of the horizontal scaffold member lie in the same plane, and further, that each end connector forms a right angle with the pipe. Hence, the twisting and misalignment problems of the prior art connectors are not present.

Finally, shown in both sidewalls 20 and 21 is slot 94. Slot 94 vertically aligns with the bottom inner folder lateral tab 93 (see FIG. 1). Slot 94 is designed to accommodate a tape measure. In a completed horizontal scaffold member, the distance between slots 94 on the two end connectors of a horizontal scaffold member should match the distance between the corresponding folder lateral tabs 93 on the two end connectors. If these lengths do not match (within tolerance), the end connectors may be misaligned, indicating the horizontal scaffold member may be damaged.

Locking Latch

The connector 19 can house the single latch mechanism (FIG. 12A) or the double latch mechanism discussed (see, e.g. FIG. 12D) previously, or any other latching configuration. The location of the lateral tabs 99 and pivot holes 96 can be customized to accommodate the latches and any biasing springs required for a particular latch design.

Figure 3:
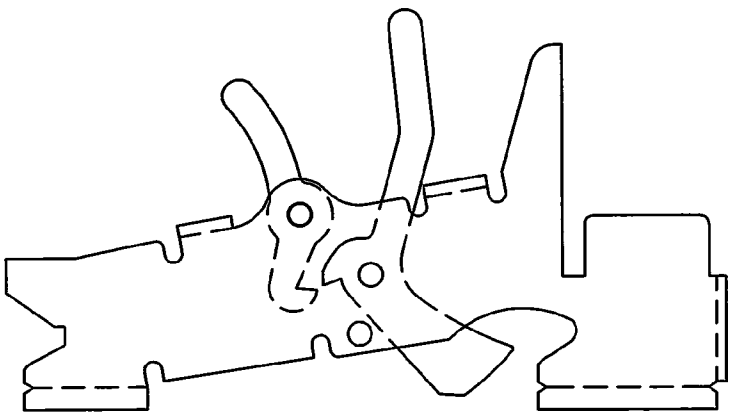
FIG. 3 is a cross section through the embodiment of the connector housing showing one embodiment of a locking latch deployed in the interior of the connector housing.
Figure 4:
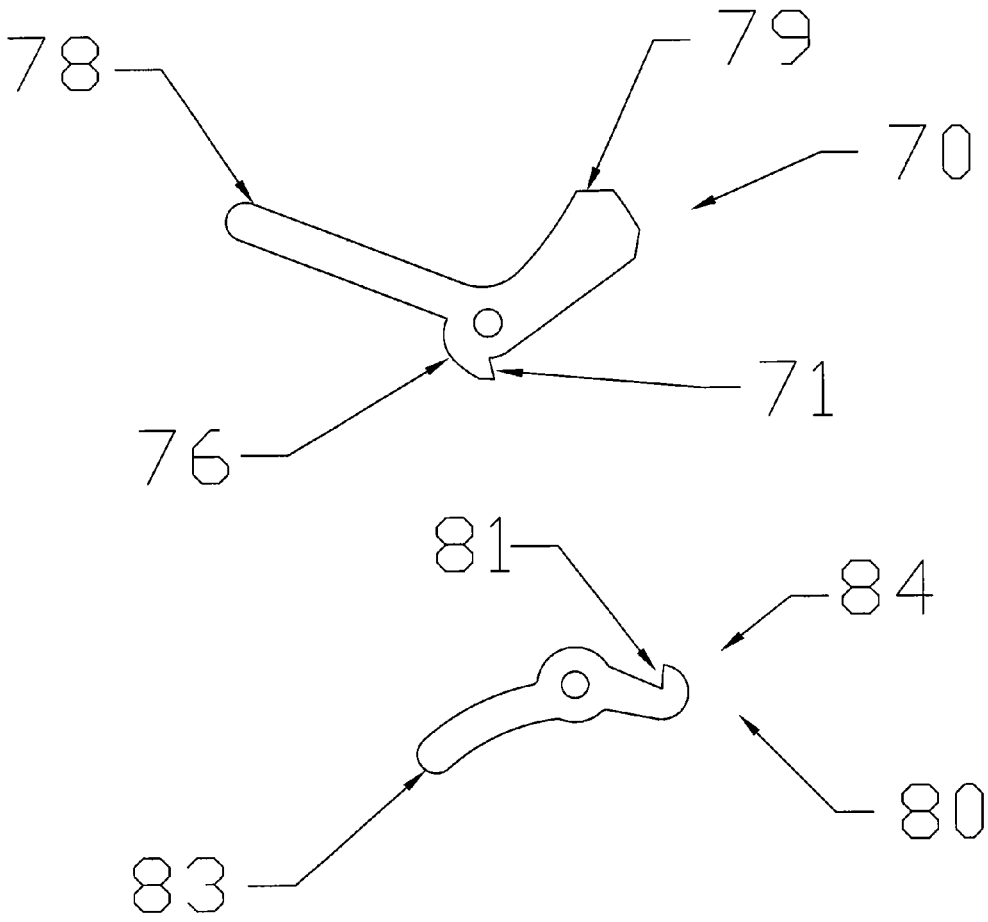
FIG. 4 is a top view of the locking latch members for the locking latch of FIG. 3
Figure 5:
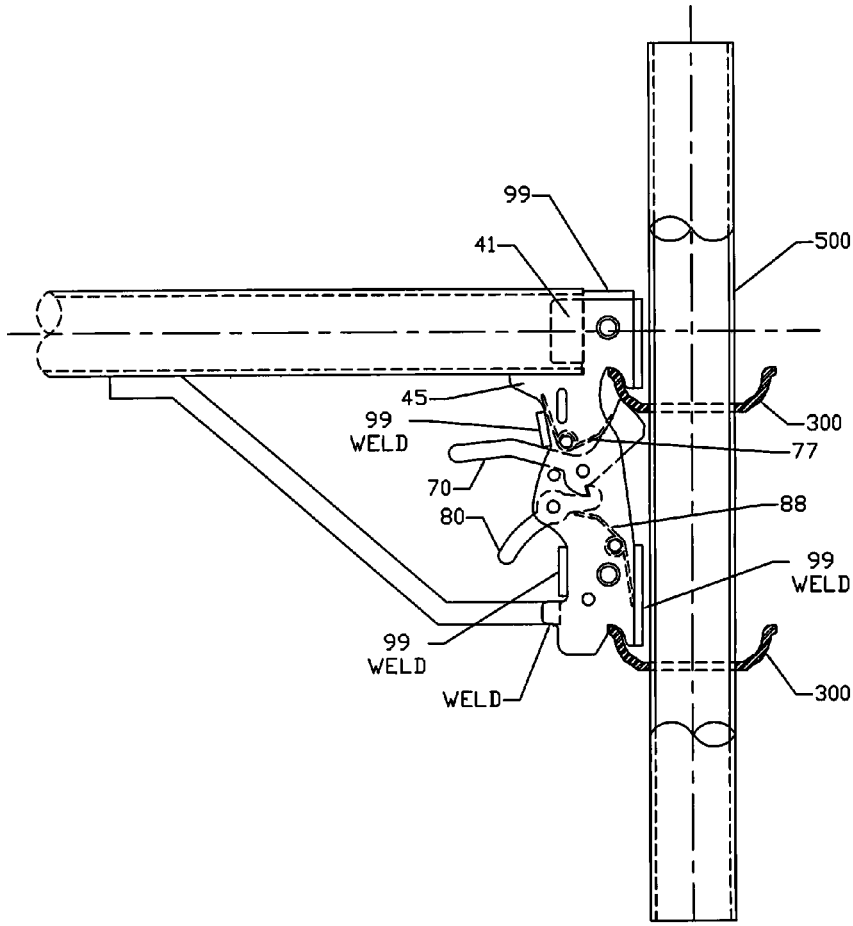
FIG. 5 is a cross section through one embodiment of a new connector housing installed in a scaffold joint, where a dual latch member is deployed within the connector housing, detailing spring loading of the latch and load members.
Figure 6:
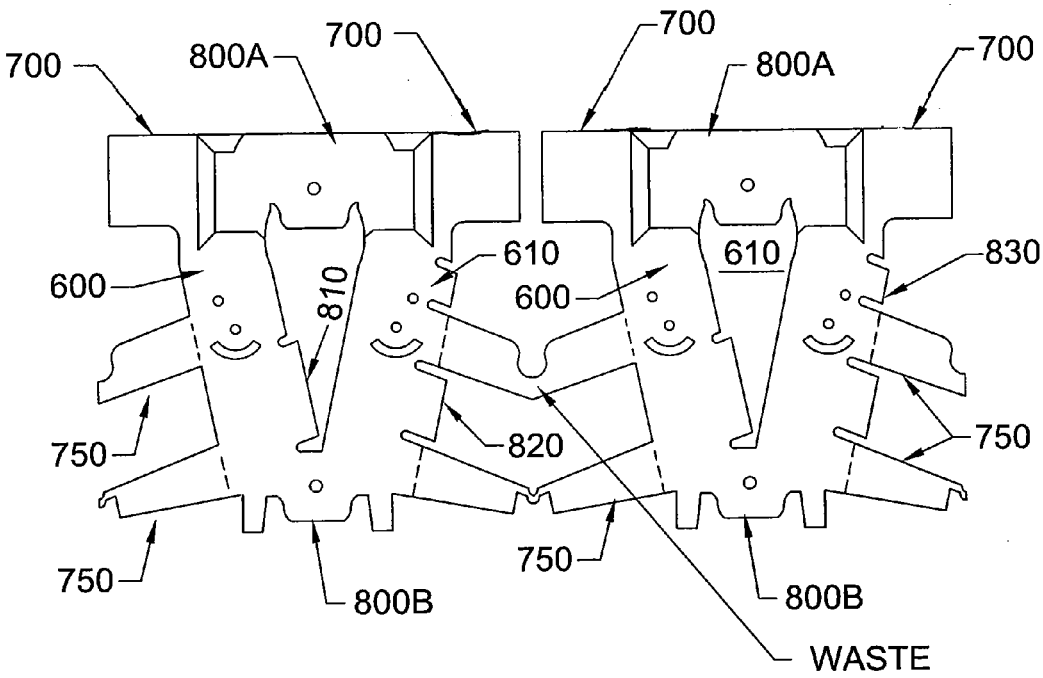
FIG. 6 is the outline of the punched prior art housing.
Figure 7A:
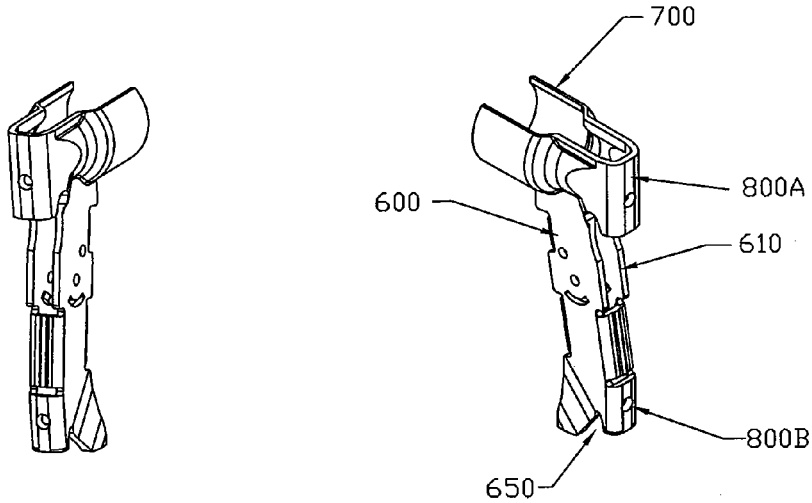
FIG. 7A are perspective views of the prior art housing design
Figure 7B:
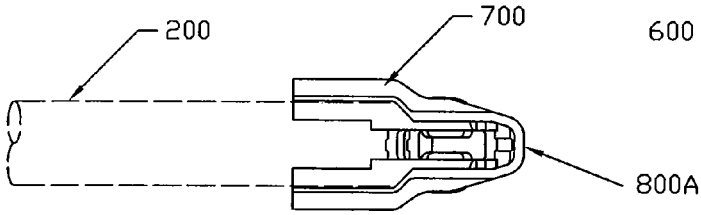
FIG. 7B is a top view of the prior art housing design of FIG. 7A
Figure 7C:
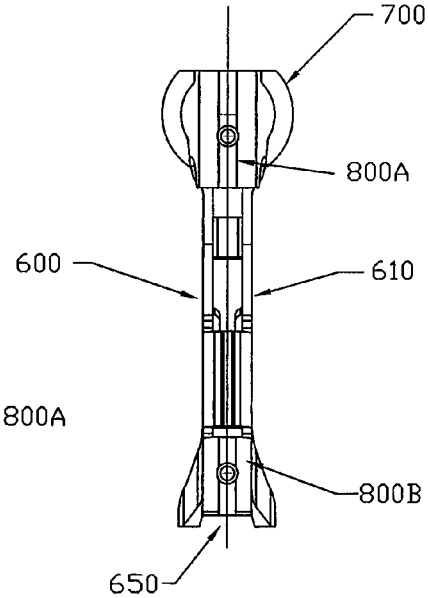
FIG. 7C is a end view of the prior art housing of FIG. 7A.
Figure 8A:
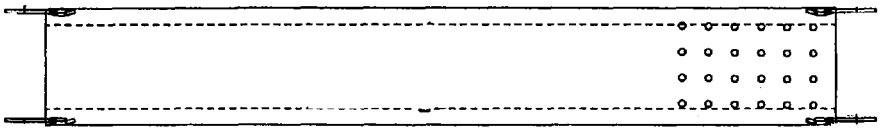
FIG. 8A is a top view of a scaffold board
Figure 8B:
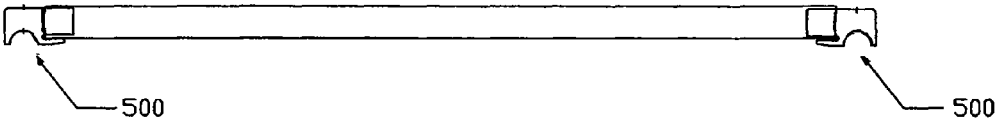
FIG. 8B is a side view of a scaffold board.
Figure 8C:
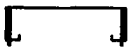
FIG. 8C is an end view of the scaffold board of FIGS. 8A and 8B.

A new locking latch is shown partially disposed in the interior of an end connector housing 19 in FIGS. 5 and 3. The locking latch comprises a upper pivoting latch member 70 and a lower pivoting lock member 80, together creating a means to lock latch member in a latched position. Each member pivots on pivot pins located in the interior of the housing (here bolts thorough the housing). The positive lock is created as latch member 70 is biased to rotate opposite that of lock member, and hence, the two members can be designed to obstruct or interfere.

The preferred upper latch member 70 is an "L" shaped body similar to that disclosed in the U.S. Pat. No. 5,078,532, having a distal end 79, the engagement end, shaped for positioning beneath a cup or annular ring (to trap the cup or ring between the latch and the hook section), and a proximal end 78 that forms a handle. As in prior embodiments, the upper latch member 70 is positioned below the top hook portion of the housing to allow the distal end 79 to be positioned beneath a ring member, annulus or cup on a vertical scaffold member. Preferably, the upper latch member 70 is biased (such as by spring 77 see FIG. 5) into an actuated position or latched position (i.e. latch member handle 78 rotates upwardly to bias the distal end 79 toward a vertical scaffold member). Biasing indicates that some positive action must be taken to move the latch from an actuated position to a released position (non-latched). A spring biasing means is not required, particularly if the distal end 79 is sufficiently weighted so that the latch member 70 will naturally be biased to rotate to the actuated or latched position when the connector is vertically orientated. The biased rotation of the latch member 70 is stopped when the handle portion 78 contacts the upper rear join area 100 (created by a folder lateral tab). Positioned on the underside of the upper latching member 70 is upper latch catch 71, a downward facing finger projection, shaped to interfere with a corresponding shaped upward facing finger projection (a lower locking catch 81) on the upper side of lower locking member 80.

A preferred pivoting lower lock member 80 has a proximal end 83 forming a handle and a distal end 84, where the lock catch 81 is positioned on the upper surface near the distal end 84. The lower lock member 80 is biased to rotate opposite that of the latching member 70 (i.e. the lock member handle is biased to rotate downwardly, such as by a spring 88 (see FIG. 5), or by a sufficiently weighted proximal handle end 83). Hence, lower lock catch 81 is biased into a locked position—engagement with upper latch catch 71. When the catches 71 and 81 are engaged, a positive lock is achieved—upper latching member 70 cannot rotate to an unlatched or released position due to the interference to such rotation caused by lock catch 81 bearing on latch catch 71. Upward rotation of the lock handle moves the lock member to an unlocked position—the lock catch is disengaged from the latch catch.

Upon engagement of the catch areas, the upper latch member 70 cannot be rotated (upward rotation of the handle is resisted by stop 100, while downward rotation of the handle is prevented by the engagement of the two catch areas). Hence, the end connector latch is normally biased into a locked actuated position. Disengagement of the locking latch cannot be achieved unless the lock member handle 83 is rotated upwardly, while latch member handle 78 is rotated downwardly. Due to the biasing of the two members 70 and 80, and the positioning of the two members 70 and 80 in the housing, this unlocking action can be achieved by an operator grasping the exposed handles (78 and 83) and squeezing the two handles together, a natural release operation. If the operator releases the handles 78, 83, the two members will again be biased so that the catch members 71 and 81 are engaged. To assist in engagement, the rear lower side 76 of locking catch 71 is curved to allow the projecting finger, or catch 71, to slide on the curved area 76 until the two locking catches 71 and 81 come into an engaged relationship.

To assemble and disassemble the scaffold joint with this locking latch, an operator must first release the lock. While it is possible to first release the lock member and then release the latch member, the more natural motion is to release both at the same time by grasping both handles and squeezing.

The locking latch apparatus described can be utilized in the prior art modular housing end connectors as well as the new end connector housing. Indeed, the locking latch can be used in an end connector designed with a single hook section (e.g. without the bottom hook section) but such is not preferred.

The invention claimed is:

1. A locking scaffold end connector comprising an end connector comprising two sides, a front and a rear portion and a top and a bottom portion, and an interior defined between said two sides, a top hook section positioned on each side at said front portion of said end connector for engagement with a vertical scaffold member, and a locking latch, said locking latch comprising:

a latch member pivoting within said interior about a pivot axis extending between said sides, said latch member having a catch, a latch handle end and an engagement end, said latch handle end and said engagement end extending outside said interior of said end connector, said engagement end positioned below said top hook section, said latch member pivotable between a latched position and a released position, said latch member biased to said latched position, said latched position adapted to latch said scaffold end connector to said a vertical scaffold member;

a lock member pivoting about a pivot axis extending between said sides within said interior, said lock member pivot axis and said latch member pivot axis being vertically spaced apart, said lock member having a catch for engaging said catch of said latch member, said lock member having a lock handle end extending outside said interior of said end connector, said lock member pivotable between a locked position and an unlocked position, said lock member biased to said locked position;

said catches of said latch member and said lock member adapted to engage one another when said latch member is in said latched position and said lock member is in said locked position, thereby resisting rotation of said latch member to said released position;

wherein said lock handle end is spaced apart from said latch handle end and said lock member and said latch member are pivotable in said interior so that when said lock handle end and said latch handle end pivot towards each other said catches of said latch member and said lock member rotate away from each other to position said lock member to said unlocked position and said latch member to said released position.

2. The locking scaffold end connector of claim 1, wherein said end connector is positioned on one end of a horizontal scaffold member.

3. The locking scaffold end connector of claim 1 wherein said catch of said latch member has a projecting finger and said catch of said lock member has a projecting finger, and wherein said latch member and said lock member catches are adapted to engage by contact of said lock finger and said latch finger.

4. The locking scaffold end connector of claim 1 wherein said lock handle end is positioned proximal to said top portion and said latch handle end is positioned distant to said top portion.

5. The locking scaffold end connector of claim 4 wherein said latch handle end pivots downwardly when pivoting to said released position.

6. The locking scaffold end connector of claim 1 wherein said latch member is biased to said latched position by a first spring positioned in said interior of said end connector.

7. The locking scaffold end connector of claim 1 wherein said lock member is biased to said locked position by a second spring positioned in said interior of said end connector.

* * * * *